United States Patent [19]

Fischer et al.

[11] 4,211,494

[45] Jul. 8, 1980

[54] DEVICE FOR GUIDING THE PRINTER NEEDLES IN A MOSAIC NEEDLE PRINTER

[75] Inventors: Philipp-Josef Fischer; Richard Reier, both of Holzkirchen, Fed. Rep. of Germany

[73] Assignee: Siemens Aktiengesellschaft, Berlin & Munich

[21] Appl. No.: 888,849

[22] Filed: Mar. 22, 1978

[30] Foreign Application Priority Data

Mar. 29, 1977 [DE] Fed. Rep. of Germany ..... 2713886

[51] Int. Cl.[2] ..... B41J 3/12

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 3,907,092 | 9/1975 | Kwan et al. | 400/124 |
| 4,005,770 | 2/1977 | Hirose et al. | 400/124 |
| 4,044,878 | 8/1977 | Kunath | 400/124 |
| 4,081,067 | 3/1978 | Schrag et al. | 400/124 |
| 4,091,909 | 5/1978 | Lee | 400/124 |

FOREIGN PATENT DOCUMENTS

| | | | |
|---|---|---|---|
| 2153005 | 3/1973 | Fed. Rep. of Germany | 400/124 |
| 1418219 | 12/1975 | United Kingdom | 400/124 |

*Primary Examiner*—Paul T. Sewell

*Attorney, Agent, or Firm*—Hill, Van Santen, Steadman, Chiara & Simpson

[57] ABSTRACT

A guide assembly for guiding the printing needles of a mosaic printing head utilizing sets of opposed interlocked multi-channelled guide plates forming sets with needle tracks formed in opposed faces of the guide plates, the guide sets extending from needle moving power devices to adjacent a printing end of the print head.

9 Claims, 8 Drawing Figures

DEVICE FOR GUIDING THE PRINTER NEEDLES IN A MOSAIC NEEDLE PRINTER

BACKGROUND OF THE INVENTION

1. Field of the Invention

This invention relates to mosaic needle print heads and more particularly to needle guide means for such print heads.

2. Prior Art

This invention is directed to that class of device which is utilized for guiding the printer needles of a mosaic needle print head such as is used in office, data or telex machines. The guide device is utilized to guide the elongated needles between the needle movement power means, generally plunger type magnets, and the printing zone of the print head adjacent where printing occurs. In the printing zone the print needles are brought close together in one or more aligned rows.

Depending upon whether the print head is constructed to reproduce upper case letters alone or lower case letters of shorter length, and whether the mosaic for forming an individual character is to be coarse or fine, a greater or lesser number of needles are required. In each instance a plurality of print needles which work in parallel to one another are required to form the vertical extent of the character to be printed. The needles form the horizontal extent of the character by being activated intermittently as the printing head moves along the print line. A standard format is a 7×5 arrangement requiring at least seven vertically disposed print needles with up to five activation points per character width for the formation of upper case letters.

In order to operate the print needles and cause them to move back and forth into and out of contact with the paper or other recording carrier being utilized, or into or out of contact with intermediate positioned ink means, power means are utilized. The normal power means are plunger type magnets which take up far more space than the height of the individual letters. Thus, the elongated printer needles which extend from the power means to the print zone must be guided from the print zone along divergent paths to the individual power means.

This necessity of guiding along divergent lines is particularly found when plunger type magnet systems are used as the power means. Such plunger type magnet systems have numerous inherent advantages which make them desirable for use in such mosaic needle printers, however, their large diameter provides a problematical power means arrangement problem since the individual needles exit from the magnet assembly, generally, in an axial center thereof.

Additionally, since the needles themselves are very thin, proper guiding of the needles from the power means to the print zone produces a number of problems. However, guiding is critical since a good guide in the zone intermediate the print zone and the power means has a decisive effect on the satisfactory operation of the overall printing head and upon the service life thereof. Thus, in recent years, considerable attention has been paid to this guiding problem and a number of suggested solutions have been attempted.

Among other things, it has been known to provide a guide device for such print needles in mosaic needle printers wherein all the drive means are aligned with their drive axes lined up on the print point. In such constructions the print needles then extend between the drive means and the print point in straight lines. It has been suggested to guide the needles at spaced intervals by support arms. However, such arrangements provide a problem in connection with the distance between the print head and the recording carrier. When the distance increases the image produced must, of necessity, become smaller since the needles are converging.

In order to eliminate this problem, it has become usual to guide the print needles in such a manner that they are parallel to one another adjacent the print zone and fan out from one another from the print zone back towards the spaced apart drive means. This requires guidance of the print needles along curved paths. However such curved paths provide further guidance problems since the print needles are now subjected to high bending stresses. It has also been suggested to provide spaced apart support arms along the length of the needles to provide a guide for the needles. In at least one known arrangement (British Pat. No. 1,418,219), the construction of such an assembly involves great care and precision in order to insure reasonably affective guidance characteristics for a relatively prolonged service life.

In contrast thereto, other devices are known wherein the print needles are guided over a major portion of the zone between the printing zone and the drive means. In one such arrangement (German laid open application No. 2,153,005), such guidance is obtained by cast guides. In order to provide the cast guide openings, master needles are provided during the casting process with a plastic block being cast around them. The production of such cast blocks is very problematical and creates a number of difficulties such as, for example, correct removal of the long thin master needles.

In at least one other suggested arrangmeent, the individual print needles are guided in guide tubes which are again provided by casting or molding.

It would therefore be an advance in the art to provide a needle guide assembly which is economical to produce, easy to assemble and disassemble, capable of providing adequate support to the needle wires and conductive of long print head life.

SUMMARY OF THE INVENTION

The above advance in the art is provided by the present invention which, beginning from the above described state of the art, provides a guide assembly for the print needles in the zone between the print zone and the power means, which guide assembly is both inexpensive and simple to produce and assemble and is reliable in operation while needing minimum maintenance.

A device which meets these requirements is provided according to this invention in that the drive means are positioned in rows either in one plane or in a plurality of planes axially aligned in each plane. Each plane of drive means is provided with a pair of interlocked guide plates which are dimensioned relative to one another to provide guide tracks for the associated printing needles. The printing needle guide tracks or guide grooves are formed in the area of the opposed surfaces of the guide plates with the tracks or grooves converging towards one another in the direction of the print zone to a point where they are almost parallel.

A construction according to this invention is distinguished, on the one hand, in that the guides for the span of the print needles between the drive means and the print zone can be produced extremely economically as plastic injection moldings and, on the other hand in that the individual needles are directed in guide tracks which are ideally suited for the individual paths of the needles. In this manner, neither the print needles nor the guide tracks will be subject to any real wear, even under a heavy load. However, should the plastic guide plates or the tracks formed in those plates exhibit wear, due to the unique design of this guide assembly, the individual components can be replaced quite simply in that the plates which combine in a pair to form the guide tracks can be removed laterally of the needles by separating the two interlocked plates.

In a preferred embodiment of this invention, the guide tracks are formed in one of the guide plates as an open groove with the groove closed by the opposed surface of the other guide plate. With this combination of two guide plates combining to form a pair or set, the overall assembly is virtually free of problems.

According to a further preferred embodiment, some of the grooves are formed in one of the plates while others of the grooves are formed in the opposed plate, the grooves being spaced from one another. This construction makes it possible to provide guide grooves which approach the print zone in two planes such that the print needles can be guided parallel with one another in each of the planes.

As shown in the illustrated embodiment, when a twelve needle print head is provided, it is particularly advantageous to dispose the drive means in banks of four which are aligned in three planes inclined towards one another. Each of the planes is then provided with a guide assembly of two guide plates with the two centermost guide grooves of each bank being formed in one of the guide plates and the outer guide grooves of each bank being formed in the other of the guide plates for the guide plate set. This arrangement makes it possible to use only four types of guide plates at any time with the pairs of guide plates allocated to the center plane drive means being flat and the two pairs of guide plates allocated to the outer planes being identically curved but installed in inverted position.

Preferably, the guide plates are provided with centering lugs for alignment with the drive means at one end and at the print zone end are provided with guide lugs which allow the guide plates to be installed in a U-shaped mounting formed in the print head. A spring plate may maintain the guide plates in the U-shaped mounting. In addition to providing for inexpensive production of the guide plates, these measures insure easy and economical assembly of the guide assembly in the print head. Thus, the guide lugs or centering lugs can, for example, be inserted into corresponding guide holes in the drive means while the opposite end of the guide plates are held in the U-shaped mounting.

It is therefore an object of this invention to provide an improved guide assembly for mosaic needle printers.

It is another, and more particular object of this invention to provide a guide assembly for the elongated needles of mosaic needle print assemblies wherein the drive means for the assemblies are located in rows with each row of needles from the drive means being guided in grooves formed in opposed faces of a snap-together guide assembly.

It is another, and more particular object of this invention to provide a guide assembly for mosaic needle print heads wherein the guide assembly consists of a plurality of pairs of guide plates with guide tracks formed in one or both of the opposed surfaces of the guide plates, the guide plates being snapped together to close the guide tracks.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
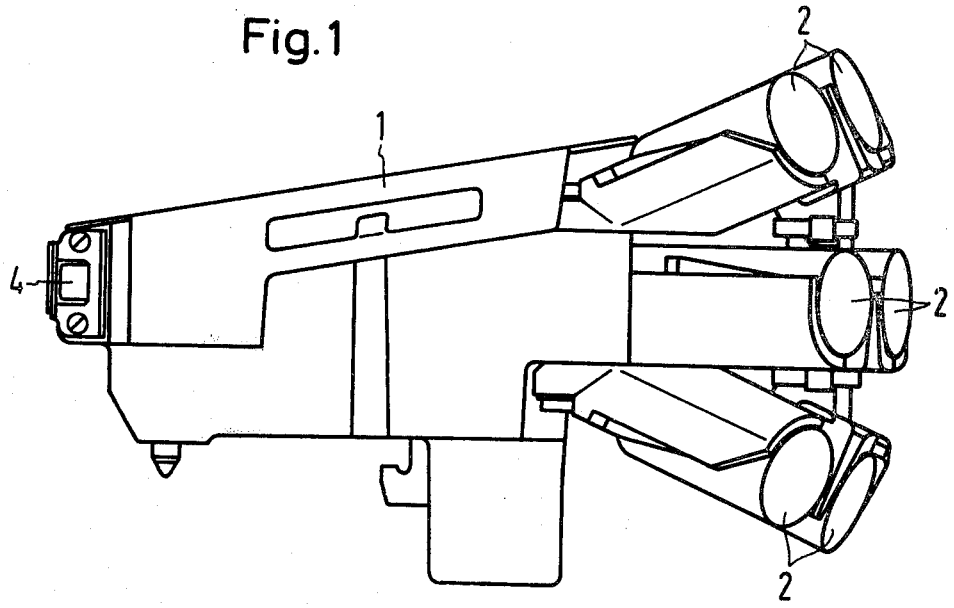
FIG. 1 is a side plan view of a mosaic needle print head equipped with a guide assembly of this invention.
Figure 2:
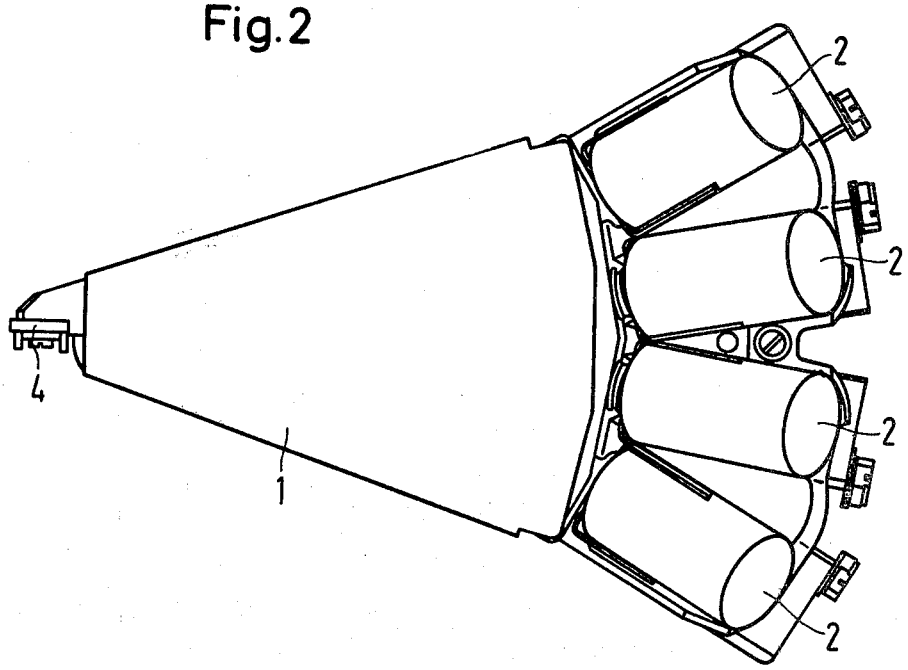
FIG. 2 is a top plan view of the print head of FIG. 1.

A mosaic needle print head particularly adapted for use in data or telex machines is illustrated in a side plan view in FIG. 1 and a top plan view in FIG. 2. The print head has two echeloned rows of six print needles each in the print zone at the print end of the printing head such that 12 character elements are available in the vertical direction to form letters. Thus, 12 plunger type magnet systems 2 are disposed in the print head 1 with the magnet systems being ranged in three planes, inclined towards one another, each of which contains four plunger type magnet assemblies 2 which are also inclined towards one another. Guide plates 5, 6, 7, and 8, provide a guide assembly for the needles 3. The guide plates are positioned between the magnet systems 2 and the print end guide 4. The guide plates are matched together in interlocking pairs.

Figure 3:
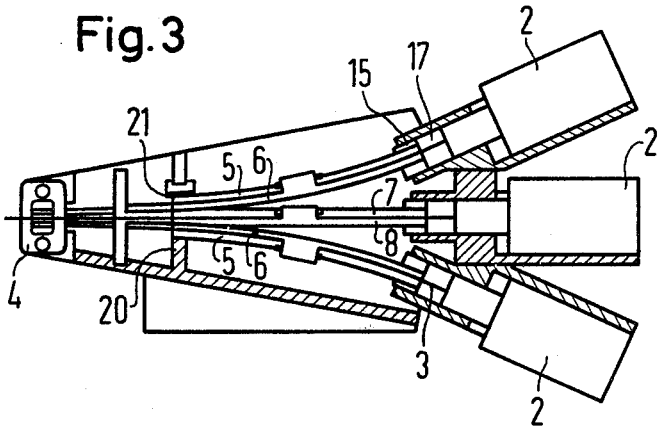
FIG. 3 is a schematic view, partially in section, of the print head of FIG. 1.

As can be seen from FIG. 3, a pair of guide plates 7 and 8 used for the central plane of four plunger magnets 2 is positioned intermediate guide plate assemblies 5, 6 which are used for the top and bottom planes. The guide plates 5, 6 are curved where the plates 7 and 8 are straight.

Each of the guide plate sets consists of two guide plates which have opposed mating faces such that each guide plate set is divided along its length from the power means 2 to a print zone end.

The print needles 3 are guided between the opposed faces. The outer curved pair of guide plates 7, 8 is shown in FIGS. 5 through 8. A pair of guide grooves 9 is formed in one face of the plate 5 whereas the pair of guide tracks 10 is formed in one face of plate 6. In the embodiment illustrated, guide plate 5 is formed with tracks 9 for receipt of the center pair of print needles 3 from the center pair of power means 2 whereas the tracks 10 formed in plate 6 are provided for the outer pair of print needles from the outer-most power means. In this embodiment, the tracks 9 and 10 are primarily formed in one or the other of the guide plates and are closed when the guide plates are snapped together with the tracks being formed along the opposed faces. Thus, the tracks 9 of plate 5 are closed by the central section of the track containing face of plate 6 whereas the tracks 10 are closed by the track containing face of plate 5. As is indicated in the figures, the opposed plate can be provided with part of an entrance opening to the tracks formed in the other plate.

In order to provide for a mechanical interlock of the two plates, the plates may be provided with molded in place snap contacts such as the catch members 11 formed on plate 6 which interlock with locking faces 12 formed on the plate 5. In this manner a form locked joinder of the two plates is easily provided.

In order to allow the print needles of each plane to lie parallel with one another, the corresponding areas 13, 14 in the plates 5, 6 are either raised or recessed so that the guide tracks are aligned with one another transverse of the guide plates when the plates are locked together. This arrangement is primarily to provide that the guide tracks 9 and 10 end in a common plane in the area of the power means 2 even though they run in either one of the two tracks formed in plate 5 or one of the two tracks formed in plate 6. Additionally, the guide plates are guided laterally and properly aligned by the mating raised and recessed configurations. In addition, centering lugs 22 can be provided in one of the plates corresponding with centering apertures 23 in the other guide plate thereby again insuring a proper locked together fit.

In order to provide for ease of attachment of the individual guide plate sets to the print head, the plates 5, 6 can be provided with projecting centering lugs 15, 16 with concentric guide contours about the particular guide tract 9 or 10 associated therewith. With these, the guide plates can be engaged in central holes or apertures 17 of the power means assemblies so that an optimum alignment of the grooves 9, 10 with the power means 2 is provided.

With the aid of additional guide lugs or tongues 18, 19, the plates 5, 6, 7, and 8 are insertible in a pre-determined position in a U-shaped mounting 20 formed in the print head 1. A spring plate 21 can then be provided to close the U-shaped mounting and to maintain the ends 18, 19 in place.

Figure 4:
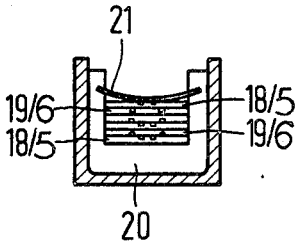
FIG. 4 is an enlarged fragmentary sectional view of the guide assembly print zone support.
Figure 5:
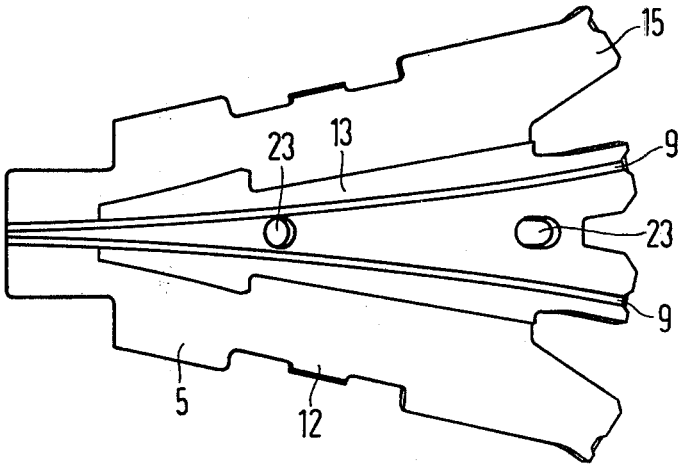
FIG. 5 is a plan view of one of the curved guide plates.
Figure 6:
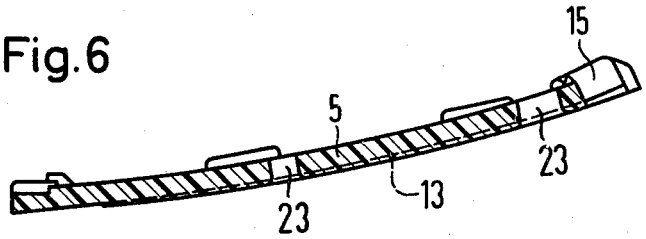
FIG. 6 is a sectional view of the plate of FIG. 5.
Figure 7:
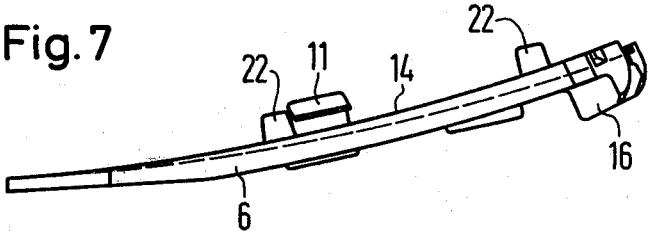
FIG. 7 is a side plan view of a guide plate mateable with the plate of FIGS. 5 and 6.
Figure 8:
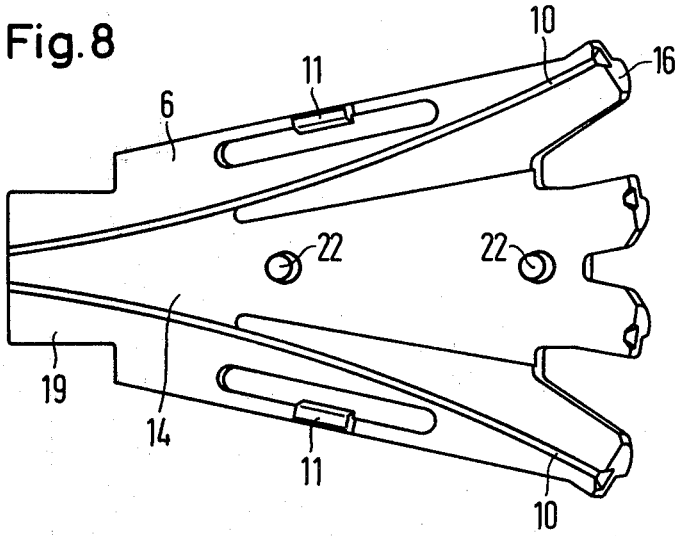
FIG. 8 is a plan view of the plate of FIG. 7.

FIG. 4 is a front or end view, partially in section, of the guide plates and the associated print head mount illustrating the arrangement of the orifice terminations at the guide plates, as indicated by the lead lines and numbers, two plates 6 and two plates 5 are used, arranged respectively above and below plates 7 and 8, as numbered in FIG. 4. The print needles 3 leaving the guide plates in the four vertical rows indicated are finally brought together into two vertical adjacent rows at the terminal guide 4 in the vicinity of the actual print point.

Of course, it is to be understood that the particular arrangement of the print head herein illustrated represents only one possible embodiment in which the guide plates of this invention can be used.

It can therefore be seen from the above that this invention provides an improved guide system for guiding printing needles of mosaic print heads from the power means to adjacent the print zone wherein guiding is accomplished by guiding the needles in guide tracks formed in opposed faces of snapped together guide plates, one such plate being provided for each plane of power means. It is assumed in the embodiment illustrated that the guide plates are vertically spaced from one another, however, they could be arranged horizontally spaced from one another with the plates extending vertically should that configuration be desired.

Although the teachings of our invention have herein been discussed with reference to specific theories and embodiments, it is to be understood that these are by way of illustration only and that others may wish to utilize our invention in different designs or applications.

We claim as our invention:

1. A device for guiding print needles in a mosaic needle printer print head assembly from adjacent a needle movement power means of a drive head assembly to adjacent a print zone where the needles are to be brought together in at least one row comprising: a print head assembly having a drive head assembly with power means affixed thereto and a print zone end spaced from the drive head assembly, a plurality of sets of guide plates formed of two guide plates having opposed surfaces, needle guiding tracks formed in at least one of the opposed surfaces and being closed by a portion of the other opposed surface, each such plate having a power end and a print end, the track diverging from the print end to the power end, means for removing the guide plates from the print head assembly including each of the guide plate sets being removable from the print head assembly and being easily disassemblable to separate the plates of each set from one another, and the sets being mountable on the print head intermediate the drive head assembly and the print zone end, each of the plates in each set being attached to the other plate through a snap together connection whereby the individual plates may each be removed from the print head assembly without disassembly of the drive head assembly.

2. The device of claim 1 wherein each guide track is formed substantially exclusively in one of the guide plates and is closed by the opposed face of the other guide plate.

3. A device according to claim 2 wherein guide tracks are formed in each of the guide plates.

4. The device according to claim 1 in combination with a print head having a plurality of drive means disposed in a plurality of individual planes with a plurality of drive means and associated needles in each plane, each plane being provided with a guide plate set, each set having guide tracks for each of the needles of the associated plane, at least some of said sets being curved in a direction normal to the plane.

5. A device according to claim 4 wherein three planes are provided, each plane having four drive means and four needles, the guide tracks for the outer two needles of each plane being formed in one guide plate and the guide tracks for the inner two needles being formed in the other guide plate of the guide plate set for that plane, the drive means being axially inclined towards one another.

6. The device according to claim 1 wherein each set of guide plates is provided with centering lugs at at least one axial end thereof for interfit with portions of the drive head assembly to locate the guide plates.

7. The device according to claim 6 wherein both longitudinal ends of each set are provided with alignment lugs for interaction with portions of the print head assembly at a drive means end and at a print zone end.

8. The device according to claim 7 wherein the alignment of the drive means end includes receptacles associated with the drive means into which the alignment lugs of the set are insertable.

9. The device according to claim 8 wherein alignment at the print zone comprises a U-shaped channel carried by said print head, the alignment lugs of the guide sets being receivable in stacked relation in the U-shaped channel and being maintained therein by a spring plate.

* * * * *